US010836155B2

(12) United States Patent
Chikuma et al.

(10) Patent No.: US 10,836,155 B2
(45) Date of Patent: Nov. 17, 2020

(54) INK JET PRINTING APPARATUS, CONTROL METHOD THEREOF AND STORAGE MEDIUM

(71) Applicant: CANON KABUSHIKI KAISHA, Tokyo (JP)

(72) Inventors: Toshiyuki Chikuma, Tokyo (JP); Yuhei Oikawa, Yokohama (JP); Yutaka Kano, Kawasaki (JP); Kohei Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/550,924

(22) Filed: Aug. 26, 2019

(65) Prior Publication Data

US 2020/0070503 A1 Mar. 5, 2020

(30) Foreign Application Priority Data

Aug. 29, 2018 (JP) ..... 2018-160240

(51) Int. Cl.
*B41J 2/045* (2006.01)

(52) U.S. Cl.
CPC ..... *B41J 2/04508* (2013.01); *B41J 2/0454* (2013.01); *B41J 2/0458* (2013.01); *B41J 2/04543* (2013.01); *B41J 2/04551* (2013.01); *B41J 2/04563* (2013.01)

(58) Field of Classification Search
CPC .... B41J 2/04508; B41J 2/0458; B41J 2/0454; B41J 2/04563; B41J 2/04551; B41J 2/04543
See application file for complete search history.

(56) References Cited

U.S. PATENT DOCUMENTS

| | | | | |
|---|---|---|---|---|
| 5,646,655 | A * | 7/1997 | Iwasaki | B41J 2/04515 347/17 |
| 7,290,855 | B2 | 11/2007 | Chikuma et al. | |
| 7,296,872 | B2 | 11/2007 | Hayashi et al. | |
| 7,296,877 | B2 | 11/2007 | Chikuma et al. | |
| 7,325,900 | B2 | 2/2008 | Hayashi et al. | |
| 7,344,219 | B2 | 3/2008 | Sakamoto et al. | |
| 7,706,023 | B2 | 4/2010 | Kanda et al. | |
| 7,819,497 | B2 | 10/2010 | Konno et al. | |
| 8,287,074 | B2 | 10/2012 | Kano et al. | |
| 8,328,311 | B2 | 12/2012 | Nakano et al. | |

(Continued)

FOREIGN PATENT DOCUMENTS

JP 2012-144039 A 8/2012

*Primary Examiner* — Yaovi M Ameh
(74) *Attorney, Agent, or Firm* — Venable LLP

(57) ABSTRACT

An object of the present disclosure is to acquire an accurate temperature of a print head. The present disclosure is an ink jet printing apparatus comprising a print head, a transmission unit configured to transmit a control signal, and a detection unit configured to detect a temperature by reading an output of a Di sensor after the transmission, and as drive conditions for driving a printing element, there is a plurality of drive conditions whose driving cycle of the printing element is different from one another, within a predetermined period in length in accordance with the driving cycle, transmission of a control signal and temperature detection are performed, a part of a line used for transmission of the control signal and a part of a line connected with the Di sensor are in common.

12 Claims, 8 Drawing Sheets

(56) References Cited

U.S. PATENT DOCUMENTS

| | | | |
|---|---|---|---|
| 8,348,372 | B2 | 1/2013 | Chikuma et al. |
| 8,384,944 | B2 | 2/2013 | Kawatoko et al. |
| 8,430,472 | B2 | 4/2013 | Nishikori et al. |
| 8,444,246 | B2 | 5/2013 | Muro et al. |
| 8,608,271 | B2 | 12/2013 | Murayama et al. |
| 8,622,538 | B2 | 1/2014 | Miyakoshi et al. |
| 8,628,163 | B2 | 1/2014 | Kanematsu et al. |
| 8,675,250 | B2 | 3/2014 | Muro et al. |
| 8,757,754 | B2 | 6/2014 | Azuma et al. |
| 8,783,832 | B2 | 7/2014 | Oonuki et al. |
| 8,876,280 | B2 | 11/2014 | Ishikawa et al. |
| 8,950,843 | B2 | 2/2015 | Oikawa et al. |
| 9,004,640 | B2 | 4/2015 | Ishikawa et al. |
| 9,028,029 | B2 | 5/2015 | Azuma et al. |
| 9,033,471 | B2 | 5/2015 | Oonuki et al. |
| 9,039,112 | B2 | 5/2015 | Murayama et al. |
| 9,079,421 | B2 | 7/2015 | Kato et al. |
| 9,114,607 | B2 | 8/2015 | Ishii et al. |
| 9,138,989 | B2 | 9/2015 | Kawatoko et al. |
| 9,393,790 | B2 | 7/2016 | Kano et al. |
| 9,409,390 | B1 | 8/2016 | Nishikori et al. |
| 9,415,960 | B2 | 8/2016 | Asano et al. |
| 9,498,961 | B2 | 11/2016 | Kano et al. |
| 9,636,906 | B2 | 5/2017 | Kawatoko et al. |
| 9,764,562 | B2 | 9/2017 | Suzuki et al. |
| 2009/0021548 | A1 | 1/2009 | Suzuki et al. |
| 2011/0310152 | A1 | 12/2011 | Muro et al. |
| 2012/0154475 | A1* | 6/2012 | Uemura ..... B41J 2/04563 347/17 |
| 2013/0176357 | A1* | 7/2013 | Yasutani ..... B41J 2/04588 347/17 |
| 2019/0299590 | A1 | 10/2019 | Oikawa et al. |
| 2019/0299592 | A1 | 10/2019 | Iwasaki et al. |
| 2019/0299599 | A1 | 10/2019 | Kano et al. |
| 2019/0299601 | A1 | 10/2019 | Oikawa et al. |

* cited by examiner

| DRIVE MODE | DRIVE FREQUENCY [kHz] | NUMBER OF TIME DIVISIONS(16) + TEMPERATURE ACQUISITION BLOCK(1) | BlkTrg INTERVAL [usec] | LF SPEED [ips] | DRIVE RESOLUTION [dpi] |
|---|---|---|---|---|---|
| Z | 1 | 17 | 58.82 | - | - |
| A | 15.6 | 17 | 3.77 | 13 | 1200 |
| B | 9.6 | 17 | 6.13 | 8 | 1200 |
| C | 7.2 | 17 | 8.17 | 6 | 1200 |
| D | 3.6 | 17 | 16.34 | 3 | 1200 |

FIG.5

INK JET PRINTING APPARATUS, CONTROL METHOD THEREOF AND STORAGE MEDIUM

BACKGROUND OF THE INVENTION

Field of the Related Art

The present disclosure relates to an ink jet printing apparatus, a control method thereof, and a storage medium.

Description of the Related Art

An ink jet printing apparatus is known that prints an image on a printing medium by using a print head having a printing element substrate provided with a plurality of printing elements generating heat energy for ejecting ink. In the ink jet printing apparatus such as this, in a case where the temperature at a portion in the vicinity of the printing element is low, the ink ejection amount is too small, and therefore, there is a concern that the density of an image to be printed is reduced. In order to address this, it is known to suppress a reduction in density resulting from the low temperature described previously by providing a heating element for heating ink on the printing element substrate, in addition to the printing element, and driving the heating element at the time of performing printing.

In order to have the configuration such as this, it is desirable to acquire temperature while performing printing. Consequently, it is commonly performed to provide a temperature sensor (specifically, diode sensor) to the print head. However, during printing, crosstalk from the data transfer clock, the transfer data, the latch signal, and the like occurs and an induced noise occurs in the output from the temperature sensor provided to the print head, and therefore, it is difficult to acquire an accurate temperature of the print head during printing.

In Japanese Patent Laid-Open No. 2012-144039, one printing cycle of the print head, which is uniquely determined based on the drive frequency of the print head, is divided into an active section necessary for the drive of the print head and an inactive section during which a temperature data signal is acquired from the temperature sensor. During the active section, a signal necessary for the drive of the print head is transferred to the print head, and on the other hand, during the inactive section, a temperature data signal output from the print head is read. Due to this, it is made possible to acquire a temperature without being affected by the crosstalk of the control signal even during printing.

SUMMARY OF THE INVENTION

However, even by using the technique disclosed in Japanese Patent Laid-Open No. 2012-144039, there is a case where it is not possible to acquire an accurate temperature of the print head depending on the structure of the print head. For example, a configuration is known in which a part of a line used for transmission of a control signal for controlling the drive of the print head and a part of a line connected with a diode sensor are made in common for reducing costs. With the print head having the structure such as this, there is a case where it is not possible to acquire an accurate temperature as a result of being affected by the crosstalk of the control signal depending on the drive condition of the print head.

Consequently, in view of the above-described problem, an object of the present disclosure is to acquire an accurate temperature of a print head irrespective of drive condition.

One embodiment of the present invention is an ink jet printing apparatus comprising: a print head including a printing element provided on a substrate in correspondence to an ejection port of ink and driven for generating energy for ejecting ink and a diode sensor for detecting a temperature of the substrate; a transmission unit configured to transmit a drive control signal for driving the printing element to the print head, wherein as drive conditions for driving the printing element, there is a plurality of drive conditions whose driving cycle of the printing element is different from one another, and within a predetermined period in length in accordance with the driving cycle, the drive control signal is transmitted to the print head by the transmission unit; a temperature detection unit configured to detect a temperature of the substrate by reading an output of the diode sensor after the transmission, wherein a part of a line used for transmission of the drive control signal and a part of a line connected with the diode sensor are in common; a determination unit configured to determine a correction amount indicating a degree in which the detected temperature is corrected for each of the plurality of drive conditions based on a temperature detected by the diode sensor; and a correction unit configured to correct a temperature detected by the diode sensor based on the correction amount corresponding to one drive condition in a case where the print head is driving in accordance with the one drive condition of the plurality of the drive conditions.

Further features of the present invention will become apparent from the following description of exemplary embodiments with reference to the attached drawings.

BRIEF DESCRIPTION OF THE DRAWINGS

FIG. 5 is a table storing values of a drive frequency, a time per block, and the like for each drive mode in the first embodiment;

DESCRIPTION OF THE EMBODIMENTS

First Embodiment

<About Configuration of Ink Jet Printing Apparatus>

Figure 1:
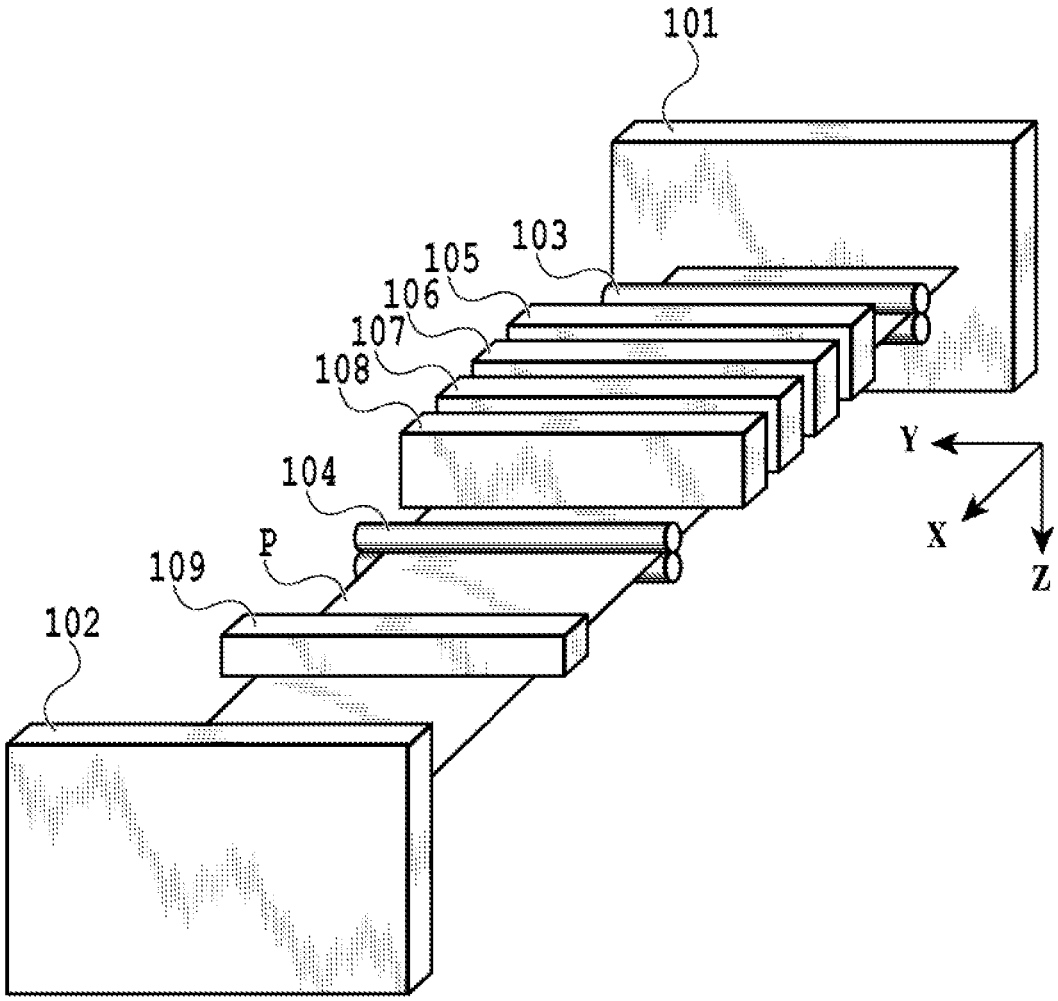
FIG. 1 is a diagram showing an internal configuration of a printing apparatus in a first embodiment.

FIG. 1 is an outline diagram showing an internal configuration of an ink jet printing apparatus (hereinafter, simply referred to as "printing apparatus") in the present embodiment.

A printing medium P fed from a feed unit 101 is conveyed (moved) at a predetermined speed in a +X-direction in FIG. 1 while being nipped by a conveyance roller pair 103 and a conveyance roller pair 104 and discharged from a discharging unit 102. In the present specification, the +X-direction is also referred to as the conveyance direction and the intersecting direction.

Between the conveyance roller pair 103 on the upstream side and the conveyance roller pair 104 on the downstream side, print heads 105 to 108 are arrayed side by side along the conveyance direction and the print heads 105 to 108 eject ink in a +Z-direction in FIG. 1 in accordance with print data. In the present specification, the +Z-direction is also referred to as the direction of gravity. The print head 105 ejects cyan ink, the print head 106 ejects magenta ink, the print head 107 ejects yellow ink, and the print head 108 ejects black ink, respectively. Each color ink is supplied to the print heads 105 to 108 from ink tanks, not shown schematically, via tubes, not shown schematically. In the present specification, cyan is represented by one letter C, magenta by M, yellow by Y, and black by K, respectively. Further, it is assumed that the coordinates shown in FIG. 1, that is, the relationship between an X-axis indicating the conveyance direction of a printing medium, a Z-axis indicating the direction of gravity, and a Y-axis perpendicular to the X-axis and the Z-axis is used in common also in the following explanation.

In the present embodiment, the printing medium P may be continuous paper held in the form of a roll in the feed unit 101 or may be cut sheets cut in advance into a standard size. In a case of the continuous paper, after the printing operation by the print heads 105 to 108 is completed, the continuous paper is cut into predetermined length by a cutter 109 and classified into discharge trays for each size in the discharging unit 102. The printing apparatus includes a temperature sensor (not shown schematically) that acquires the temperature within the apparatus.

<About Configuration of Print Head>

Figure 2A:
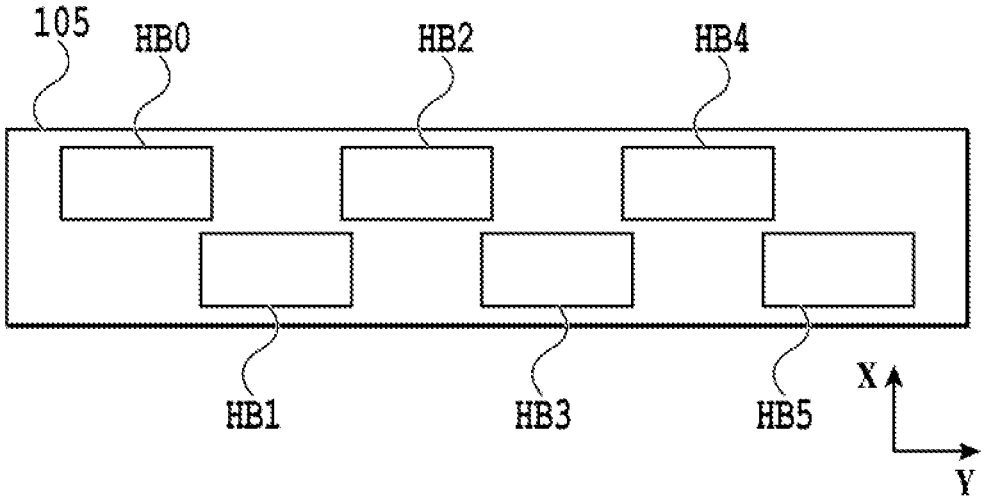
FIG. 2A to FIG. 2C are diagrams showing a print head and heater boards in the first embodiment.

FIG. 2A is a diagram for explaining the configuration of the print head 105 of the C ink in the present embodiment. In the following, for simplicity, only the print head 105 of the print heads 105 to 108 is described, but the print heads 106 to 108 other than the print head 105 also have the same configuration as that of the print head 105.

As shown in FIG. 2A, in the present embodiment, the print head 105 is provided with six heater boards (printing element substrates) HB0 to HB5. Each heater board is arranged side by side along a predetermined direction (specifically, in a Y-direction in which the print head extends) so that the end portions overlap in part in the Y-direction. As described above, by using the print head in which the six heater boards HB0 to HB5 are arranged in the Y-direction, as in the case where a long print head including only one heater board is used, it is made possible to perform printing for the entire area of a printing medium having a width long in the Y-direction.

Figure 2B:
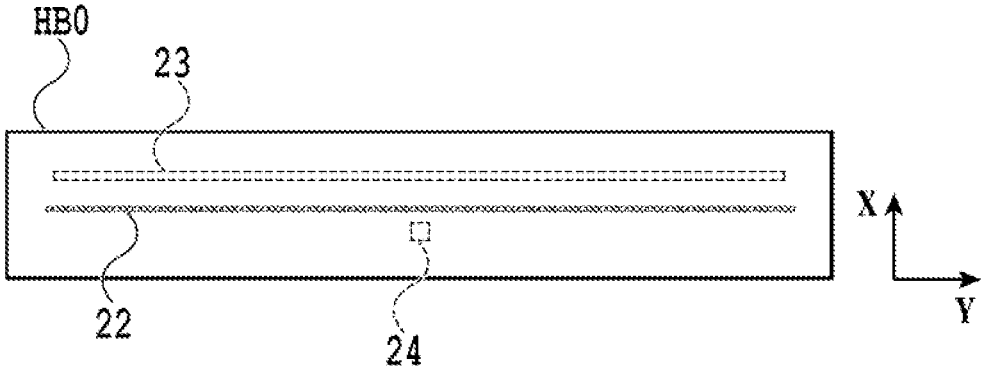

FIG. 2B is a diagram for explaining the configuration of the heater board HB0 of the heater boards HB0 to HB5. Here, the heater board HB0 is explained, but the other heater boards HB1 to HB5 also have the same configuration as that of the heater board HB0.

As is known from FIG. 2B, the heater board HB0 is provided with an ejection port row 22, a sub heater (also referred to as a heating element) 23 for heating ink, and a temperature sensor (also referred to as a detecting element) 24 for detecting temperature. The sub heater is a metal, the temperature sensor is a semiconductor, and an ejection port member whose film is formed on a silicon substrate and including the ejection port row 22 formed by a resin or metal is further joined to the silicon substrate by bond and the like.

In the ejection port row 22, a plurality of ejection ports (also referred to as nozzles) for ejecting the C ink is arrayed side by side in the Y-direction. Inside each ejection port configuring the ejection port row 22, a printing element (not shown schematically) corresponding to each ejection port is arranged. This printing element is used to generate heat energy by being driven by application of a drive pulse and thereby cause ink to bubble, and perform the ejection operation from each ejection port. In the following, a row including the printing elements inside each of the ejection ports configuring the ejection port row 22 is also referred to as a printing element row.

Further, the sub heater 23 is a member for heating ink in the vicinity of the printing element within the heater board HB0 to a degree in which the ink is not ejected. Furthermore, the temperature sensor 24 is a member for detecting the temperature in the vicinity of the printing element within the heater board HB0.

Here, the aspect is described in which the one sub heater 23 and the one temperature sensor 24 are provided within the heater board HB0, but a plurality of the sub heaters 23 and a plurality of the temperature sensors 24 may be provided within the heater board HB0. Further, the number of sub heaters 23 and the number of temperature sensors 24 may be the same or may be different.

Figure 2C:
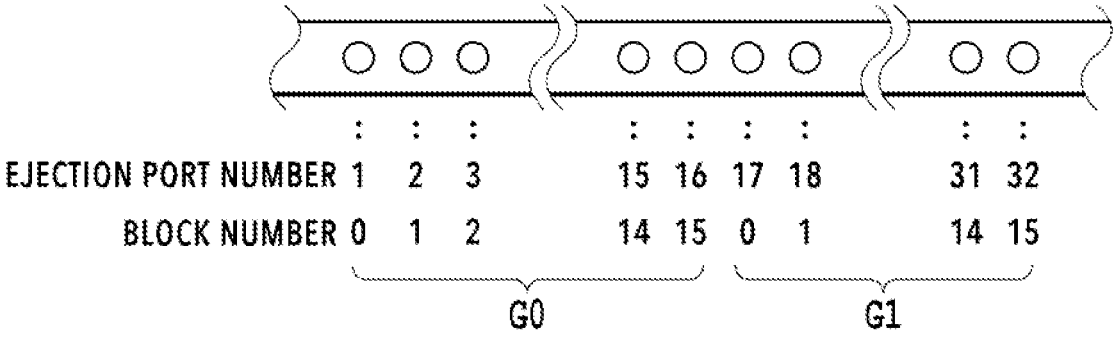

As shown in FIG. 2C, the ejection port row 22 is divided into groups (G0, G1, . . . ) of 16 ejection ports and the ejection ports of each group are assigned to one of 16 blocks (block numbers 0 to 15) and perform drive in a time division manner.

<About Printing Control System>

Figure 3:
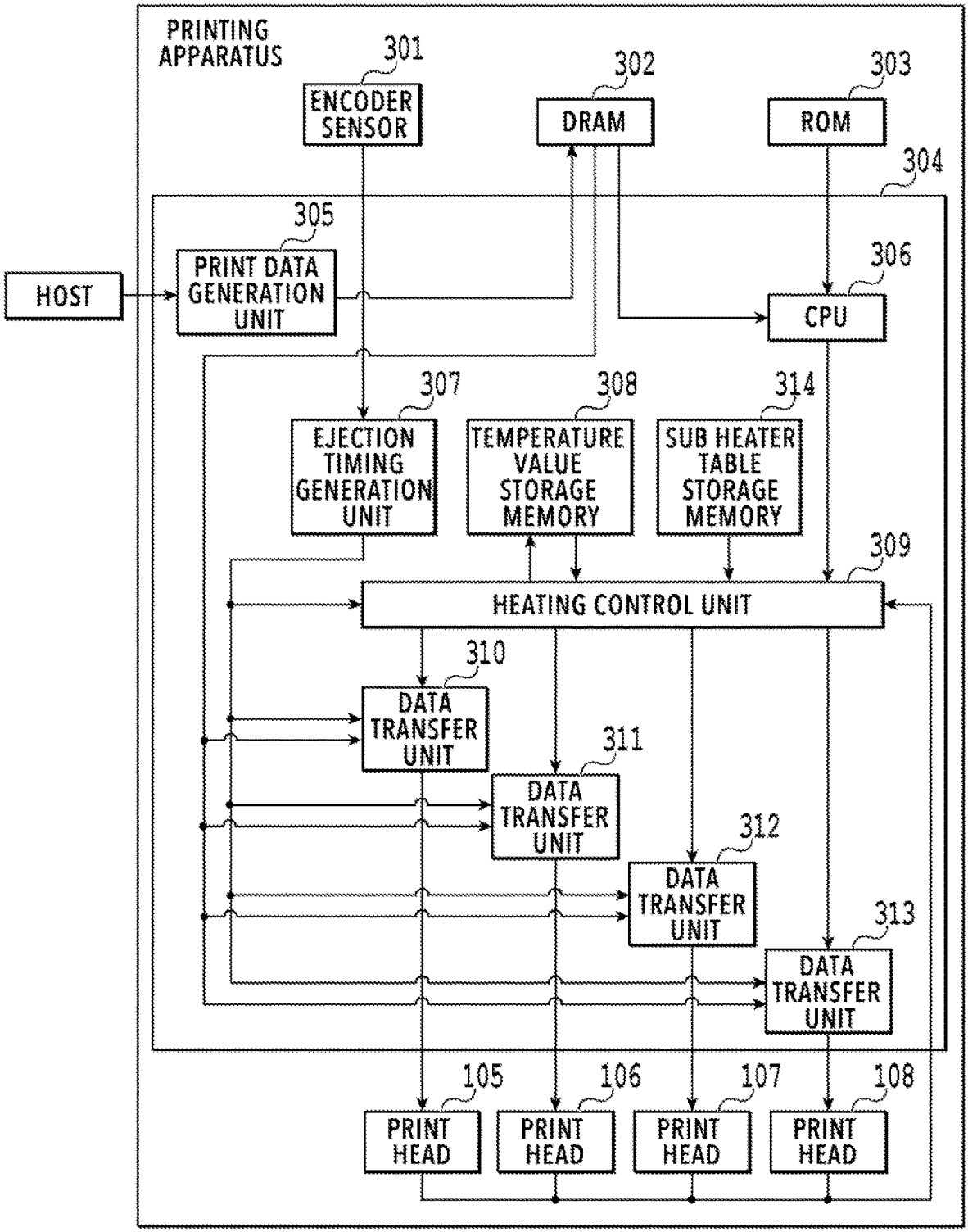
FIG. 3 is a block diagram showing a print control system within the printing apparatus in the first embodiment.

FIG. 3 is a block diagram showing the configuration of the printing control system within the printing apparatus in the present embodiment. As shown in FIG. 3, the printing apparatus includes an encoder sensor 301, a DRAM 302, a ROM 303, a controller (ASIC) 304, and the print heads 105 to 108.

The controller 304 includes a print data generation unit 305, a CPU 306, an ejection timing generation unit 307, a temperature value storage memory 308, a heating control unit 309, a sub heater table storage memory 314, and data transfer units 310 to 313.

The CPU 306 controls the operation of the entire printing apparatus by loading a program stored in the ROM 303 onto the DRAM 302 and executing the loaded program to implement each function module. Further, in the ROM 303, fixed data necessary for various operations of the printing apparatus is stored, in addition to various control programs, such as programs used for performing the printing control in the printing apparatus, which is performed by the CPU 306.

The DRAM 302 is necessary for the CPU 306 to execute programs and used as a work area of the CPU 306, used as a temporary storage area of various kinds of received data, and stores various kinds of setting data. In FIG. 3, only the one DRAM 302 is described, but it may also be possible to mount a plurality of DRAMs or to configure the printing apparatus so as to include a plurality of memories different in access speed by mounting both DRAM and SRAM.

The print data generation unit 305 receives image data from a host (PC) outside the printing apparatus, performs color conversion processing, quantization processing, and the like for the received image data to generate print data used for ink ejection from each of the print heads 105 to 108, and stores the print data in the DRAM 302.

The ejection timing generation unit 307 receives position information indicating a relative position of each of the print heads 105 to 108 and the printing medium P, which is detected by the encoder sensor 301. Then, the ejection timing generation unit 307 generates information indicating timing of performing ejection (referred to as ejection timing) from each of the print heads 105 to 108, so-called ejection timing information, based on the position information.

The data transfer unit 310 reads the print data stored in the DRAM 302 in accordance with the ejection timing indicated by the ejection timing information generated in the ejection timing generation unit 307. Similarly, each of the data transfer units 311 to 313 reads the print data stored in the DRAM 302 in accordance with the ejection timing indicated by the ejection timing information generated in the ejection timing generation unit 307.

Further, the data transfer unit 310 generates information that is used for driving the sub heater in the print head 105 based on the temperature information on each of the heater boards HB0 to HB5 of the print head 105, which is stored in the temperature value storage memory 308. Similarly, each of the data transfer units 311 to 313 generates information for driving the sub heater in each print head based on the temperature information on each of the heater boards HB0 to HB5 of each of the print heads 106 to 108, which is stored in the temperature value storage memory 308. The information for driving the sub heater, which is generated by the data transfer unit, is referred to as sub heater drive information. Then, the data transfer unit 310 transfers the read print data and the generated sub heater drive information to the print head 105. Similarly, each of the data transfer units 311 to 313 transfers the print data and the sub heater drive information to each of the print heads 106 to 108.

The print heads 105 to 108 eject ink by driving each printing element based on the transferred print data and at the same time, output data indicating the temperature detected by the temperature sensor 24 of each of the heater boards HB0 to HB5 within the print heads 105 to 108 to the heating control unit 309. Then, the heating control unit 309 updates the temperature information by storing the data in the temperature value storage memory 308. At the next generation timing of the sub heater drive information, this temperature information after the updating is used.

<About Problem in the Present Embodiment>

In the following, the problem in the present embodiment, specifically, the problem that may occur in temperature acquisition using the temperature sensor 24 provided in the print head is explained anew by using FIG. 4 to FIG. 6C.

Figure 4:
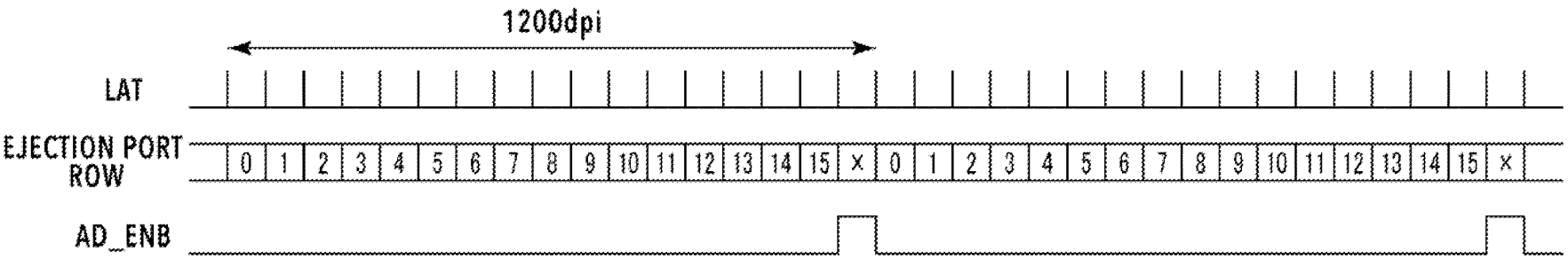
FIG. 4 is a diagram showing a drive block and a temperature acquisition block in the first embodiment.

FIG. 4 is a diagram showing drive blocks and temperature acquisition blocks and in detail, a diagram showing the way one column cycle (one printing cycle or one driving cycle) is divided into 17 cycles. Here, details of the number of divisions "17" are the number of drive blocks (number of time divisions) "16" and the number of temperature acquisition blocks "1". Further, an AD_ENB signal in FIG. 4 is a signal representing the temperature acquisition block. For example, in a case where the print head is divided into blocks of 16 ejection ports and the divide drive is performed for each block at a drive frequency of 15.6 [KHz] as shown in FIG. 2C, the time of one column cycle is about 64 [μsec]. Further, at this time, the temperature acquisition time is about 3.8 (=64×1/17) [μsec].

FIG. 5 is a table storing information on each drive mode specifying the drive condition at the time of driving the printing apparatus. In this table, each value of the drive mode, the drive frequency, the number of divisions, the time per block (this time is referred to as BlkTrg interval), the conveyance speed of a printing medium, and the drive resolution is described. Drive modes A to D are drive modes (referred to as print modes) used for the actual printing operation. In contrast to this, a drive mode Z is a drive mode used at the time of acquiring a reference temperature. The drive mode Z, which is a mode for determining a correction amount (referred to as correction amount determination mode) by acquiring a reference temperature, will be described later in detail. For example, in the drive mode A, the conveyance speed of a printing medium is 13 [ips (inch/sec)] and the drive resolution is 1,200 [dpi (dot/inch)]. In a case of the operation in the drive mode A, the frequency is calculated as 15.6 [kHz] by equation (1) below.

$$13\ [\text{ips}] \times 1{,}200\ [\text{dpi}] \qquad \text{[Mathematical equation 1]}$$

As described above, the frequency is 15.6 [kHz] and the one column cycle is divided into 17 cycles (number of drive blocks 16+number of temperature acquisition blocks 1), and therefore, both the printing time of one block and the temperature acquisition time are 3.8 (=64×1/17) [μsec]. The reason a plurality of drive modes is prepared is to enable the selective use in accordance with a situation, for example, such as that in a case where printing is performed at a high speed on plain paper, the drive mode A capable of ejection at a high frequency is used and on the other hand, in a case where printing is performed on dedicated paper, such as glossy paper, the drive mode D in which priority is given to image quality and the conveyance speed is reduced is used.

Figure 6A:
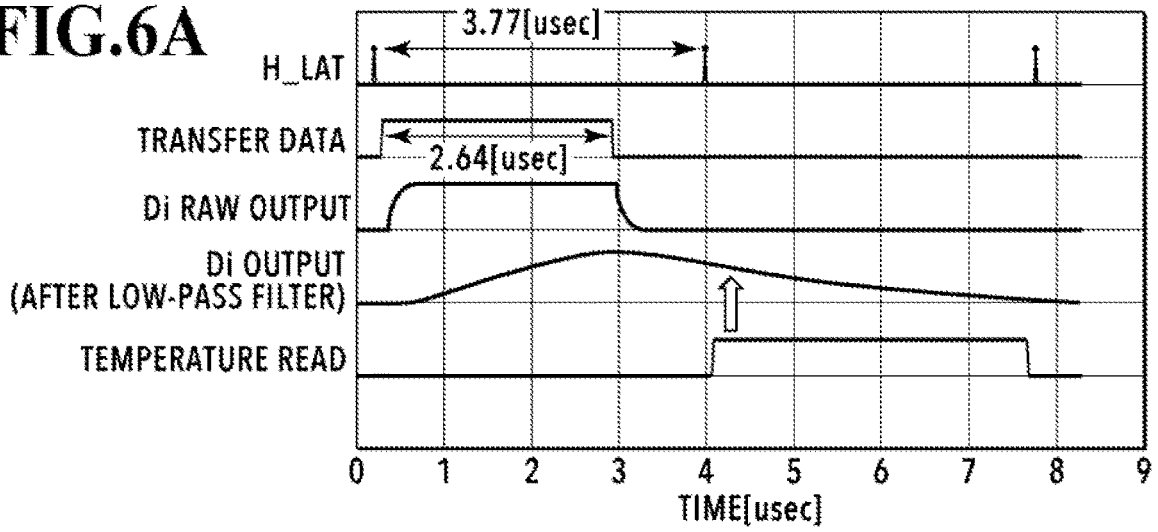
FIG. 6A to FIG. 6C are each a diagram explaining an error at the time of temperature read in each drive mode in the first embodiment.
Figure 6B:
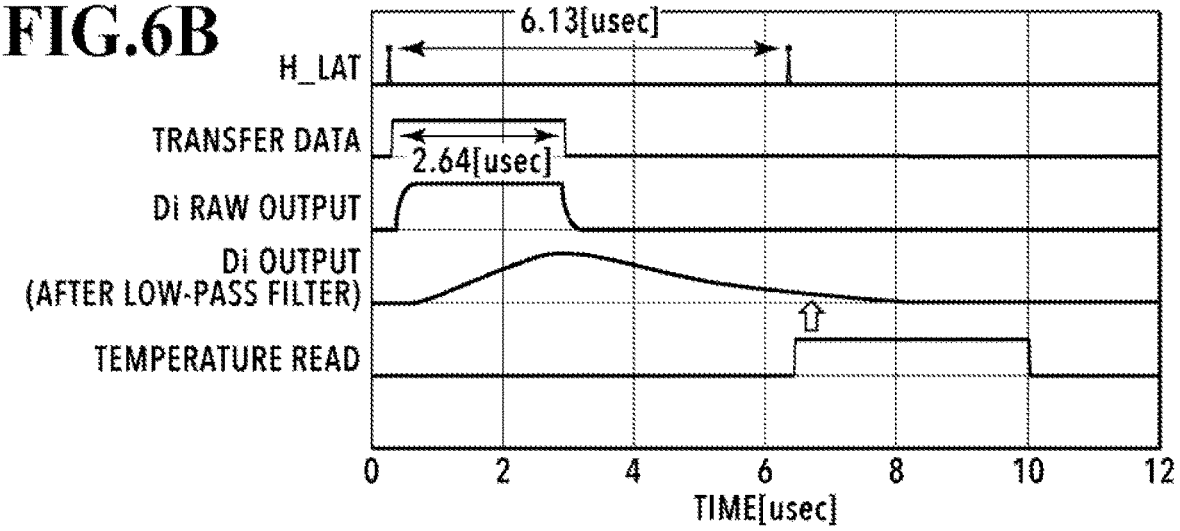
Figure 6C:
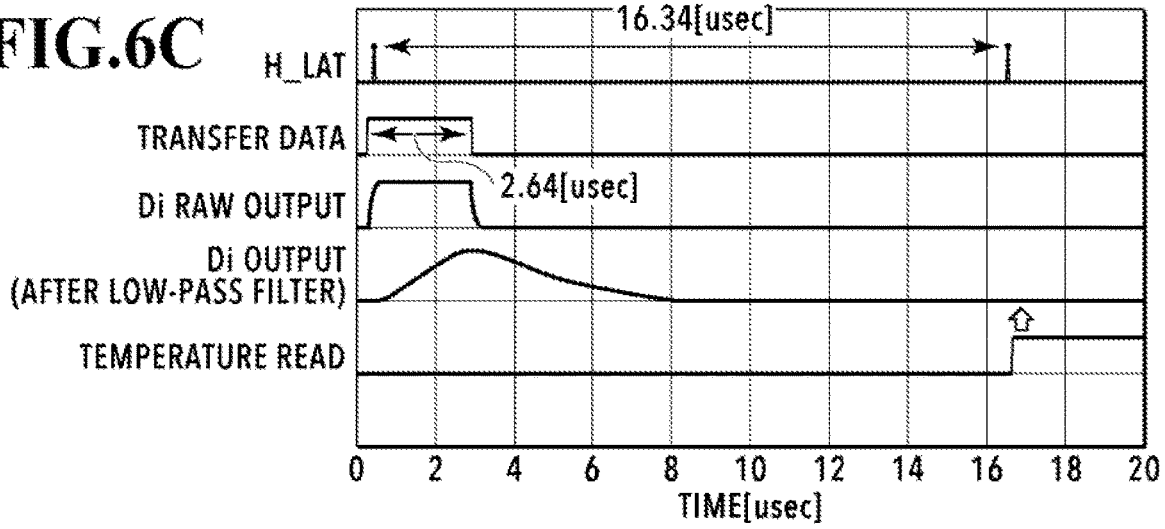

FIG. 6A to FIG. 6C are each an image diagram explaining an error at the time of temperature read, which is produced accompanying a VSS variation in each drive mode, for the printing apparatus including the print head in which a part of a line used for transmission of a drive control signal and a part of a line connected with a Di sensor are in common. In detail, FIG. 6A to FIG. 6C each show the way the transmission of a control signal to the print head and the temperature detection by reading an output from the Di sensor after the transmission are performed within a predetermined period. Specifically, FIG. 6A shows the state of the drive mode A, FIG. 6B shows the state of the drive mode B, and FIG. 6C shows the state of the drive mode D, respectively. In the present specification, a drive control signal is simply described as a control signal.

Each timing chart shown in FIG. 6A to FIG. 6C, respectively, shows, from top to bottom, the generation timing of a latch signal, the data transmission section, the raw output value of the temperature sensor, the output value of the temperature sensor output after passing through a low-pass filter, and the temperature acquisition section.

A latch signal (H_LAT) of transfer data occurs every one block time. As described previously, the one block time is the time obtained by dividing the total number of the number of drive blocks and the number of time acquisition blocks (in this example, 17 (=16+1)) by the one column cycle. Specifically, as shown also in the BlkTrg interval in FIG. 5, the one block time of the drive mode A is 3.77 [μsec] (see FIG. 6A). Further, the one block time of the drive mode B is 6.13 [μsec] (see FIG. 6B) and the one block time of the drive mode D is 16.34 [μsec] (see FIG. 6C).

The transfer data is a data signal (LVDS signal) that controls the drive of the print head. The number of pieces of data to be transferred and the transfer clock do not depend on the drive mode, and therefore, the data transfer time is constant irrespective of the drive mode and in this example, 2.64 [μsec].

In the Di sensor output (temperature sensor output), VSS floating occurs resulting from that the ground (GND) of the signal line of the print head and the GND of the temperature sensor are in common in the section where there is transfer data, but the VSS variation is eliminated quickly after the data transfer. However, in the circuit within the print head, by providing a low-pass filter, the potential variation is dulled, and therefore, the Di output after passing through the low-pass filter takes a long time until recovery.

Because of this, although the temperature is read in the block next to the block whose data is transferred, the elimination of the VSS variation that has occurred in the immediately previous block is not completed, and therefore, the influence remains at the time of temperature read. Then, the degree of the influence is greater in the drive mode that drives at a higher frequency as shown in FIG. 6A to FIG. 6C. The temperature acquisition section shown in FIG. 6A to FIG. 6C is intended for the whole time required for the processing also including the processing, such as A/D conversion accompanying the temperature read, in addition to the temperature read, and the actual temperature read is performed in the first half of the temperature acquisition section.

<About Temperature Correction in the Present Embodiment>

In the present embodiment, the temperature correction that takes into consideration the problem described previously is performed, specifically, the offset amount at the time of temperature acquisition is derived, which differs in accordance with the drive frequency, and the temperature correction is performed based on the derived offset amount. As an outline of the correction method, the temperature acquired in the state where the print head is driven at the drive frequency that is not affected by data transfer is used as the reference temperature. By calculating the difference between the reference temperature and the temperature acquired in the state where the print head is driven at the drive frequency corresponding to each drive mode, which is prepared on the side of the printing apparatus, the temperature correction amount for each drive mode is determined. In the following, the temperature correction amount determination processing in the present embodiment is explained in detail by using FIG. 7.

First, at step S71, the CPU 306 sets the drive mode of the printing apparatus to the mode for acquiring the reference temperature, in detail, to the mode in which the printing apparatus is driven at a sufficiently low frequency so as to avoid the influence of the VSS variation. As described previously, in this example, the drive mode Z whose drive frequency is 1 [KHz] corresponds to the mode such as this, and therefore, at this step, the CPU 306 sets the drive mode of the printing apparatus to the drive mode Z. In the following, "step S-" is simply abbreviated to "S-".

At S72, the CPU 306 acquires temperatures (referred to $T_{HB0}$ to $T_{HB5}$, respectively) of the heater boards HB0 to HB5 in the drive mode Z by performing temperature read by the Di. The general term of the heater board temperature in a case where it is not necessary to distinguish the heater boards from one another in particular is referred to as $T_{HB}$.

At S73, the CPU 306 determines the temperatures $T_{HB0}$ to $T_{HB5}$ of the heater boards HB0 to HB5 in the drive mode Z, which are acquired at S72, as the reference temperature of each heater board. Here, the reference temperatures of the heater boards HB0 to HB5 are referred to as $Tref_{HB0}$ to $Tref_{HB5}$, respectively, and the general term of the reference temperature in a case where it is not necessary to distinguish the heater boards from one another in particular is referred to as Tref. The reference temperature Tref is the temperature that serves as the reference at the time of correcting the Di output in each drive mode and by using the reference temperature Tref, the temperature correction amount in each drive mode is determined at S74 and subsequent steps below.

At S74, the CPU 306 sets the drive mode of the printing apparatus to the mode that is used for the actual printing operation. As described previously, in this example, the drive modes A to D correspond to the mode such as this (see FIG. 5), and therefore, at this step, the CPU 306 sets the drive mode of the printing apparatus to the drive mode i (here, i is one of A to D). In the following, explanation is given by taking a case where the drive mode is first set to the drive mode A at this step as an example.

At S75, the CPU 306 acquires the detected temperature by the Di provided in each HB. Here, in the drive mode i, the detected temperatures by the Di in the heater boards HB0 to HB5 are referred to as $Ti_{HB0}$ to $Ti_{HB5}$, respectively, and the general term of the detected temperature in a case where it is not necessary to distinguish the heater boards from one another in particular is referred to as Ti. In a case where the printing apparatus is driving in the drive mode A, at this step, detected temperatures $TA_{HB0}$ to $TA_{HB5}$ by the Di in each HB for the drive mode A are acquired.

At S76, the CPU 306 subtracts the detected temperature Ti in the drive mode i, which is acquired at S75, from the reference temperature Tref acquired at S73. Due to this, the value (this value is defined as the temperature correction amount) for correcting the Di output in each HB for the drive mode i in which the printing apparatus is driving currently is determined. In a case where the printing apparatus is driving in the drive mode A, at this step, the temperature correction amount of the Di output in each HB for the drive mode A (1 [KHz], one predetermined frequency (in other words, predetermined cycle)) is determined.

At S77, the CPU 306 determines whether the determination of the temperature correction amount at S76 is completed for all the drive modes used in the actual printing operation. In a case where determination results at this step are affirmative, the series of processing is terminated. On the other hand, in a case determination results at this step are negative, the processing returns to S74. Then, the drive mode of the printing apparatus is set to the drive mode for which the temperature correction amount is not determined yet. For example, in a case where the determination of the temperature correction amount for the drive mode A is completed, but the determination of the temperature correction amounts for the other drive modes B to D is not completed yet, determination results at this step are negative, and therefore, the processing returns to S74 and the same processing as that described previously is repeated. Due to this, the temperature correction amount for each print mode (that is, the temperature correction amounts of the drive mode B, the drive mode C, and the drive mode D, respectively) is determined sequentially.

As described above, by repeating the processing at S74 to S77 for each drive mode, the temperature correction amount for each drive mode is determined. In this example, after the determination of the temperature correction amount for the drive mode D is completed, it is determined that the determination of the temperature correction amounts for all the drive modes used in the actual printing operation is completed (YES at S77) and the series of processing is terminated. The above is the contents of the temperature correction amount determination processing in the present embodiment. After this, in a case where temperature detection by the Di is performed while the printing apparatus is driving in each drive mode, the temperature correction based on the temperature correction amount corresponding to the drive mode in which the printing apparatus in driving currently is performed by the CPU 306.

<About Effect, Modification Example of the Present Embodiment>

According to the present embodiment, even in a case where whatever drive mode is used at the time of printing, it is made possible to acquire the accurate temperature of the print head without being affected by the data transfer to the print head.

In the aspect described previously, the drive mode Z only for acquiring the reference temperature, which is not used in the actual printing operation, is prepared, but the mode such as this does not necessarily need to be prepared. In a case where there is a print mode whose speed is so slow (in other words, whose drive frequency is so low) that the influence of the VSS variation is avoided among the drive modes used in the actual printing operation, it may also be possible to acquire the reference temperature by using the print mode.

Further, in the aspect described previously, for all the print modes used in the actual printing operation, the temperature is acquired (S75) and the temperature correction amount is determined (S76), but the present embodiment is not limited to this aspect and can also be applied to another aspect. For example, it may also be possible to determine the temperature correction amount only for the drive mode at a certain specific drive frequency and determine the temperature correction amounts for the other drive modes by using a predetermined equation based on a difference in frequency from that of the drive mode for which the temperature correction amount is determined.

Further, in a case where there is a drive mode whose speed is so slow (in other words, whose drive frequency is so low) that the influence of the VSS variation is avoided, it is not necessary to perform temperature correction for such a drive mode, and therefore, it may be possible not to determine the temperature correction amount.

Second Embodiment

In the first embodiment, the aspect is described in which the temperature acquired in the state where the printing apparatus is driving in the drive mode that is not affected by data transfer at the time of temperature acquisition is used as a reference and the temperature correction amount for correcting the temperature acquired in the state where the printing apparatus is driving in another drive mode is determined. The present embodiment describes that the temperature correction amount determination processing such as this is performed at appropriate timing (this timing is referred to as correction timing). In the following, differences from the already-described embodiment are mainly explained and explanation of the same contents as those of the already-described embodiment is omitted appropriately.

The reason the correction timing is specified and the temperature correction amount determination processing is performed at appropriate timing is as follows. For example, the print head at the time of printing is in a state where temperature is likely to vary to some degree by the influence of the heating operation and the temperature maintaining operation necessary for ink ejection. The state such as this is a factor of an error and is not desirable as the timing of determining the temperature correction amount. Consequently, by specifying the correction timing so that the temperature correction amount determination processing is not performed at the timing such as this and limiting the timing of determining the temperature correction amount, it is made possible to determine a more accurate temperature correction amount and perform temperature correction.

<About Control of Execution Timing of Temperature Correction Amount Determination Processing>

Figure 8:
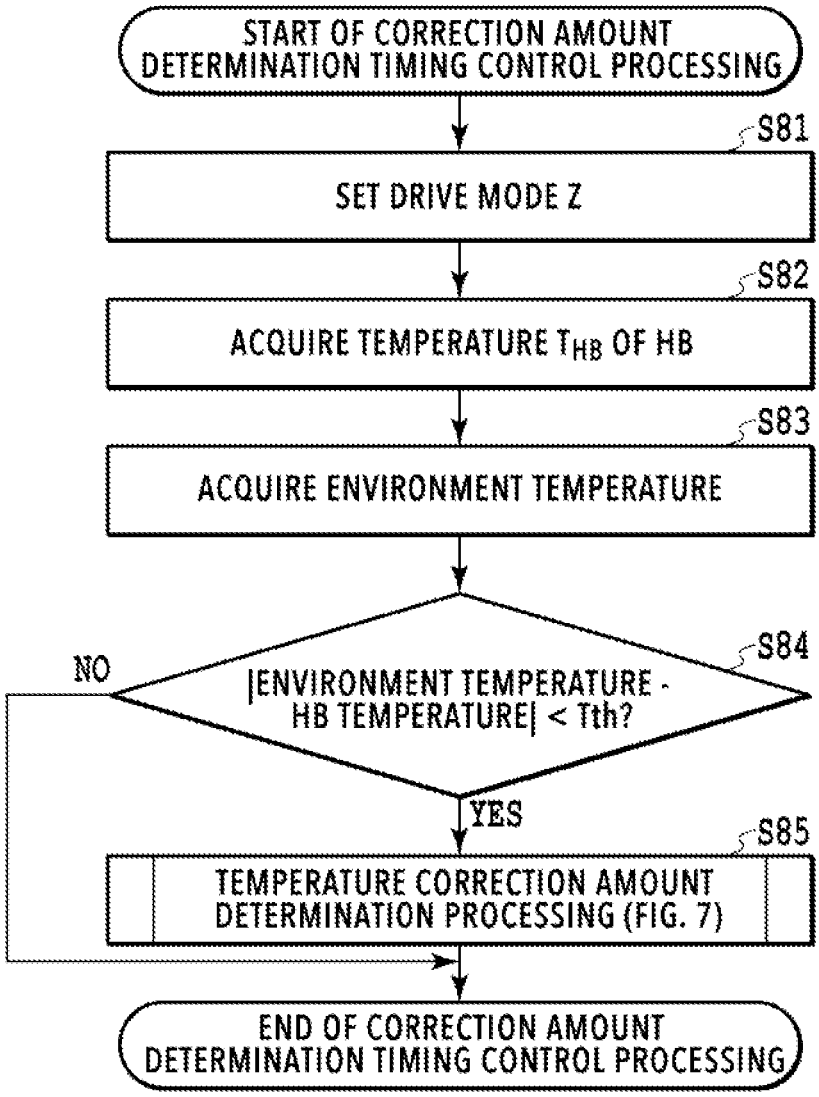
FIG. 8 is a flowchart of correction amount determination timing control processing in a second embodiment.

In the following, processing to control execution timing of the temperature correction amount determination processing (referred to as correction amount determination timing control processing) in the present embodiment is explained by using FIG. 8. FIG. 8 is a flowchart of the correction amount determination timing control processing including the temperature correction amount determination processing described previously. The following processing is started by a user performing a predetermined operation on a home screen that is displayed on a display of the printing apparatus, and the like.

At S81, the CPU 306 sets the drive mode of the printing apparatus to the mode in which the data transfer to the print head does not affect the temperature detection by the temperature sensor. As described previously, in the present example, the drive mode Z corresponds to the mode such as this, and therefore, at this step, the CPU 306 sets the drive mode of the printing apparatus to the drive mode Z.

At S82, by performing temperature read by the Di, the CPU 306 acquires the temperatures $T_{HB0}$ to $T_{HB5}$ of the heater boards HB0 to HB5 in the drive mode Z.

At S83, the CPU 306 acquires the temperature of the environment in which the printing apparatus is installed. In the present embodiment, the CPU 306 acquires the temperature within the apparatus by using a temperature sensor included in the printing apparatus and makes use of the acquired temperature within the apparatus as the environment temperature.

At S84, the CPU 306 calculates the absolute value of the difference between the environment temperature acquired at S83 and the temperature $T_{HB}$ of the heater board, which is acquired at S82, and determines whether the calculated absolute value is lower than a predetermined temperature (referred to as Tth). In a case where determination results at this step are affirmative, the processing advances to S85 and on the other hand, in a case where the determination results are negative, the series of processing is terminated. In this example, it is assumed that two degrees are set as the Tth.

In a case where the calculated absolute value is lower than the predetermined temperature Tth at S84, the print head and the inside of the apparatus are in a stable state where a change in temperature is unlikely to occur and the state is regarded as a state suitable for determining the temperature correction amount. On the other hand, in a case where the calculated absolute value is higher than or equal to the predetermined temperature Tth, the print head and the inside of the apparatus are in an unstable state where a change in temperature is likely to occur and the state is regarded as a state not suitable for determining the temperature correction amount.

Figure 7:
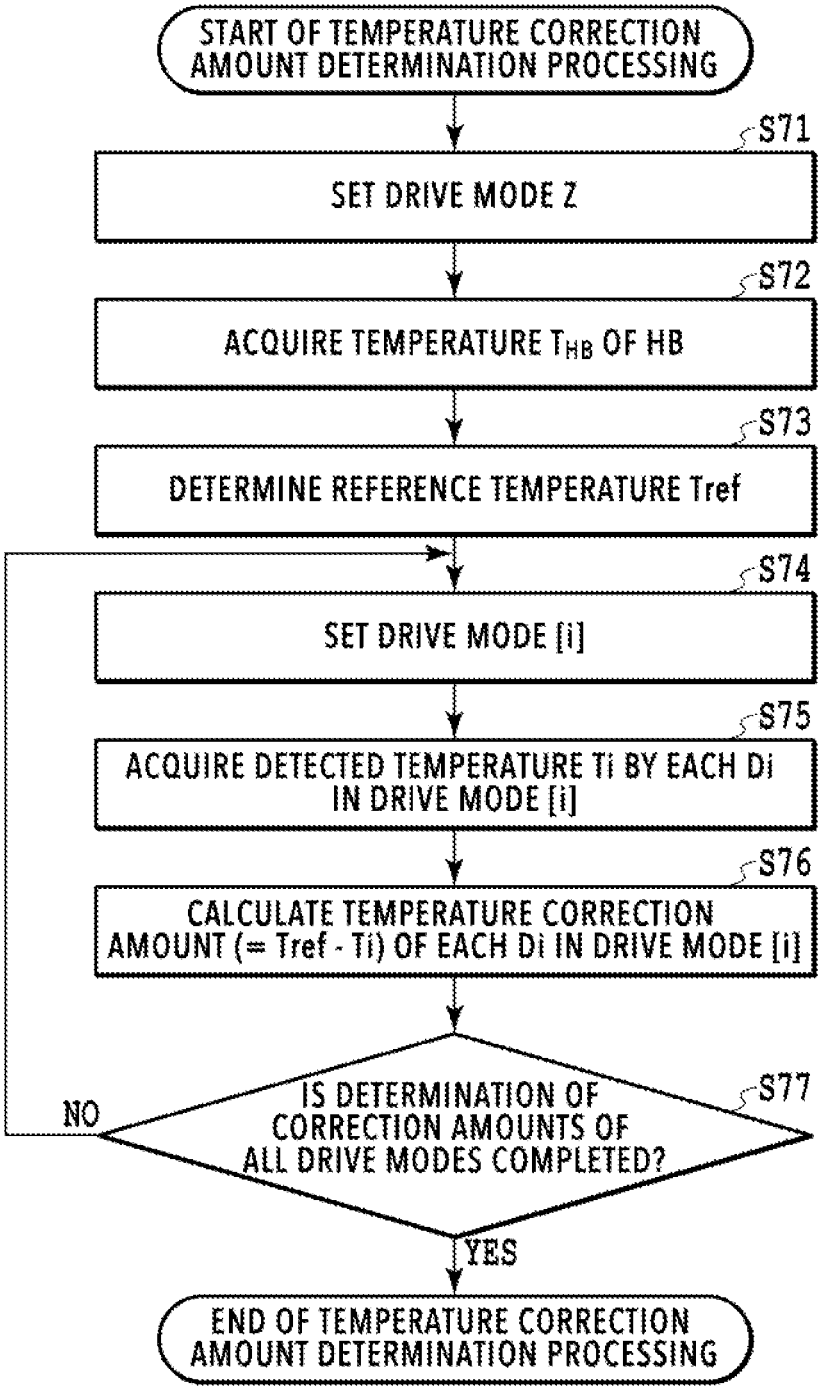
FIG. 7 is a flowchart of temperature correction amount determination processing in the first embodiment.

In a case where it is determined that the absolute value of the difference is lower than the predetermined threshold value at S84 (that is, in a case of YES at S84), at S85, the CPU 306 performs the temperature correction amount determination processing shown in FIG. 7 and the series of processing is terminated. On the other hand, in a case where it is determined that the absolute value of the difference is higher than or equal to the predetermined threshold value at S84 (that is, in a case of NO at S84), the series of processing is terminated without performing the temperature correction amount determination processing.

The above is the contents of control of the execution timing of the temperature correction amount determination processing in the present embodiment.

<About Effect, Modification Example of the Present Embodiment>

According to the present embodiment, it is made possible to perform the temperature correction amount determination processing in a stable state where a change in temperature is unlikely to occur. As a result, it is made possible to accurately determine a temperature correction amount, and therefore, it is made possible to acquire an accurate temperature of the print head.

In the aspect described previously, whether or not the timing is suitable for determining a temperature correction amount is determined by determining whether the absolute value of the difference between the temperature of the print head and the environment temperature (temperature within the apparatus) is lower than the predetermined temperature, but the present embodiment is not limited to this aspect and it is possible to apply the present embodiment to another aspect. For example, it may also be possible to determine whether the timing is suitable for determining a temperature correction amount by determining whether, based on at least one of the elapsed time from the previous printing, the elapsed time from turning off of the power source of the printing apparatus, and the duration of the state where the print head is capped, the time is longer than or equal to a predetermined time. That is, the aspect only needs to be capable of performing the temperature correction amount determination processing at arbitrary timing at which the temperature of the print head is estimated to have become stable. Alternatively, it may also be possible to perform the temperature correction amount determination processing at timing at which it is estimated that the print head and the printing apparatus main body are substantially in the same state, such as the state immediately after a new print head is attached in print head exchange.

Other Embodiments

In the aspect described previously, the temperatures are acquired in the reference drive mode and another drive mode, respectively, and the temperature correction amount for each Di for each drive mode is determined based on the difference between the acquired temperatures, but the thought of the present application is not limited to the aspect such as this. For example, it may also be possible to prepare in advance the temperature correction amount for each drive mode as a fixed value.

Further, in the aspect described previously, the aspect is described in which the temperature correction amount determination processing is performed in response to instructions of a user, but the thought of the present application is not limited to the aspect such as this. For example, it may also be possible to perform the temperature correction amount determination processing of the present application in a case where inspection is made at the time of product shipment in a factory.

Further, in the aspect described previously, the aspect is described in which ink is heated by driving the sub heater at the time of heating control, but an aspect may also be accepted in which a short pulse is applied to the printing element of the heater board and ink is heated by driving the printing element to a degree in which ink is not ejected. Furthermore, it may also be possible to adjust the ejection amount by changing the width of the drive pulse used for ejection without performing the temperature maintaining operation, in place of adjusting the ejection amount by heating and maintaining temperature by using the sub heater.

Still furthermore, in the aspect described previously, the print head that covers the width of a printing medium (multihead method) is supposed (see FIG. 1), but it is possible to provide the thought of the present application also to a serial printer aspect.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present disclosure, it is made possible to acquire an accurate temperature of a print head irrespective of drive condition.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No.2018-160240, filed Aug. 29, 2018, which is hereby incorporated by reference wherein in its entirety.

What is claimed is:

1. An ink jet printing apparatus comprising:

a print head including a printing element provided on a substrate in correspondence to an ejection port of ink and driven for generating energy for ejecting ink and a diode sensor for detecting a temperature of the substrate;

a transmission unit configured to transmit a drive control signal for driving the printing element to the print head, wherein as drive conditions for driving the printing element, there is a plurality of drive conditions whose driving cycle of the printing element is different from one another, and within a predetermined period in length in accordance with the driving cycle, the drive control signal is transmitted to the print head by the transmission unit;

a temperature detection unit configured to detect a temperature of the substrate by reading an output of the diode sensor after the transmission, wherein a part of a line used for transmission of the drive control signal and a part of a line connected with the diode sensor are in common;

a determination unit configured to determine a correction amount indicating a degree in which the detected temperature is corrected for each of the plurality of drive conditions based on a temperature detected by the diode sensor; and a correction unit configured to correct a temperature detected by the diode sensor based on the correction amount corresponding to one drive condition in a case where the print head is driving in accordance with the one drive condition of the plurality of the drive conditions.

2. The ink jet printing apparatus according to claim 1, wherein the drive conditions include at least a frequency for driving the printing element.

3. The ink jet printing apparatus according to claim 2, wherein the ink jet printing apparatus drives in one of a plurality of drive modes and for each of the plurality of drive modes, one drive condition of the plurality of drive conditions is associated.

4. The ink jet printing apparatus according to claim 3, wherein the plurality of drive modes includes a determination mode used for determination of the correction amount and a plurality of print modes used in a case where printing is performed actually.

5. The ink jet printing apparatus according to claim 4, wherein the frequency corresponding to the determination mode is the lowest of the frequencies corresponding to each of the plurality of drive modes.

6. The ink jet printing apparatus according to claim 4, wherein the determination unit determines the correction amount by using a temperature detected by the diode sensor as a reference temperature in a case where the ink jet printing apparatus is driving in the determination mode.

7. The ink jet printing apparatus according to claim 6, wherein the determination unit determines the correction amount corresponding to the print mode based on a difference between the reference temperature and a temperature detected by the diode sensor in a case where the ink jet printing apparatus is driving in one print mode of the plurality of print modes.

8. The ink jet printing apparatus according to claim 1, further comprising:

an acquisition unit configured to acquire an environment temperature, wherein the determination unit determines the correction amount in a case where an absolute value of a difference between an environment temperature acquired by the acquisition unit and a temperature detected by the diode sensor is smaller than a predetermined threshold value and does not determine the correction amount in a case where the absolute value is more than or equal to the predetermined threshold value.

9. The ink jet printing apparatus according to claim 1, further comprising:

a determination unit configured to determine whether or not to determine the correction amount based on at least one of an elapsed time from the previous printing, an elapsed time after a power source is turned off, and duration of a state where the print head is capped.

10. The ink jet printing apparatus according to claim 1, wherein in a case where the print head is attached to the ink jet printing apparatus, the determination unit determines the correction amount.

11. A control method of an ink jet printing apparatus comprising:

a print head including a printing element provided on a substrate in correspondence to an ejection port of ink and driven for generating energy for ejecting ink and a diode sensor for detecting a temperature of the substrate;

a transmission unit configured to transmit a drive control signal for driving the printing element to the print head; and a temperature detection unit configured to detect a temperature of the substrate by reading an output of the diode sensor, wherein as drive conditions for driving the printing element, there is a plurality of drive conditions whose driving cycle of the printing element is different from one another, within a predetermined period in length in accordance with the driving cycle, the drive control signal is transmitted to the print head by the transmission unit, the temperature detection unit detects a temperature of the substrate after the transmission, and a part of a line used for transmission of the drive control signal and a part of a line connected with the diode sensor are in common, the control method comprising:

a step of determining a correction amount indicating a degree in which the detected temperature is corrected for each of the plurality of drive conditions based on a temperature detected by the diode sensor; and a step of correcting a temperature detected by the diode sensor based on the correction amount corresponding to one drive condition in a case where the print head is driving in accordance with the one drive condition of the plurality of drive conditions.

12. A non-transitory computer readable storage medium storing a program for causing a computer to perform a control method of an ink jet printing apparatus comprising:

a print head including a printing element provided on a substrate in correspondence to an ejection port of ink and driven for generating energy for ejecting ink and a diode sensor for detecting a temperature of the substrate;

a transmission unit configured to transmit a drive control signal for driving the printing element to the print head; and a temperature detection unit configured to detect a temperature of the substrate by reading an output of the diode sensor, wherein as drive conditions for driving the printing element, there is a plurality of drive conditions whose driving cycle of the printing element is different from one another, within a predetermined period in length in accordance with the driving cycle, the drive control signal is transmitted to the print head by the transmission unit, the temperature detection unit detects a temperature of the substrate after the transmission, and a part of a line used for transmission of the drive control signal and a part of a line connected with the diode sensor are in common, the control method comprising:

a step of determining a correction amount indicating a degree in which the detected temperature is corrected for each of the plurality of drive conditions based on a temperature detected by the diode sensor; and a step of correcting a temperature detected by the diode sensor based on the correction amount corresponding to one drive condition in a case where the print head is driving in accordance with the one drive condition of the plurality of drive conditions.

* * * * *